US012679520B2

(12) United States Patent
Kermorgant

(10) Patent No.: US 12,679,520 B2
(45) Date of Patent: Jul. 14, 2026

(54) UPRIGHTING DEVICE FOR AN UNDERWATER VEHICLE

(71) Applicant: EXAIL ROBOTICS, La Garde (FR)

(72) Inventor: Hervé Kermorgant, La Valette du Var (FR)

(73) Assignee: EXAIL ROBOTICS, La Garde (FR)

( * ) Notice: Subject to any disclaimer, the term of this patent is extended or adjusted under 35 U.S.C. 154(b) by 384 days.

(21) Appl. No.: 18/569,644

(22) PCT Filed: Jun. 28, 2022

(86) PCT No.: PCT/FR2022/051275
§ 371 (c)(1),
(2) Date: Dec. 13, 2023

(87) PCT Pub. No.: WO2023/275476
PCT Pub. Date: Jan. 5, 2023

(65) Prior Publication Data

US 2024/0294241 A1 Sep. 5, 2024

(30) Foreign Application Priority Data

Jun. 29, 2021 (FR) ..... 2106967

(51) Int. Cl.
*B63G 8/26* (2006.01)
*B63G 8/00* (2006.01)
*B63G 8/22* (2006.01)

(52) U.S. Cl.
CPC ..... *B63G 8/26* (2013.01); *B63G 8/001* (2013.01); *B63G 8/22* (2013.01); *B63G 2008/004* (2013.01)

(58) Field of Classification Search
CPC . B63G 8/26; B63G 8/001; B63G 8/22; B63G 2008/004; B63G 8/14;
(Continued)

(56) References Cited

U.S. PATENT DOCUMENTS 2,263,553 A * 11/1941 Borracci ..... B63G 8/14 114/330
5,848,574 A * 12/1998 Lande ..... B63C 7/003 114/39.17

(Continued)

FOREIGN PATENT DOCUMENTS

CN 205916310 2/2017
CN 110203362 9/2019

(Continued)

OTHER PUBLICATIONS

International Search Report for application No. PCT/FR2022/051275 dated Oct. 24, 2022.

*Primary Examiner* — Anthony D Wiest
(74) *Attorney, Agent, or Firm* — Perman & Green, LLP

(57) ABSTRACT

An autonomous underwater vehicle, which includes a hull extending along a longitudinal main axis, and at least one vehicle uprighting device configured to alter a trim angle of the vehicle between a nominal horizontal position of the vehicle and a vertical position of the vehicle, characterised in that the vehicle uprighting device includes one or more arms mounted on the hull by a proximal end and rotatably hinged to the hull, and including a float at a distal free end.

14 Claims, 7 Drawing Sheets

(58) Field of Classification Search
CPC ..... B63G 2008/002; B63B 2211/02; B63B 34/20; B63B 43/14; B63B 34/26
See application file for complete search history.

(56) References Cited

U.S. PATENT DOCUMENTS

| | | | |
|---|---|---|---|
| 9,381,987 | B1 | 7/2016 | Dufour et al. |
| 2015/0284064 | A1 | 10/2015 | Dufour et al. |

FOREIGN PATENT DOCUMENTS

| | | | | | |
|---|---|---|---|---|---|
| GB | 2335888 | | | 10/1999 | |
| GB | 2414968 | A | * | 12/2005 | ..... B63B 22/18 |
| JP | H0263993 | A | * | 3/1990 | |
| JP | 2006232070 | | | 9/2006 | |

* cited by examiner

UPRIGHTING DEVICE FOR AN UNDERWATER VEHICLE

CROSS-REFERENCE TO RELATED APPLICATIONS

This application is a National Stage of International Application No. PCT/FR2022/051275 having an International Filing Date of 28 Jun. 2022, which designated the United States of America, and which International Application was published under PCT Article 21(2) as WO Publication No. 2023/275476, which claims priority from and the benefit of French Patent Application No. 2106967, filed on 29 Jun. 2021, the disclosures of which are incorporated herein by reference in their entireties.

BACKGROUND

Field

The present disclosure relates to underwater vehicles, in particular autonomous underwater vehicles, better known under the acronym AUV.

In particular, the disclosure relates to a system for varying a trim angle of such an AUV, in particular to place it in a vertical or nearly vertical position.

Brief Description of Related Developments

AUVs are generally designed to navigate in a so-called horizontal nominal position in water. In this nominal position, the AUV has a zero or virtually zero trim angle, and finds itself in a so-called equilibrium position in the water. Its trim angle is defined by the angle between its longitudinal axis and a horizontal plane. Navigation in the horizontal nominal position reduces drag forces and minimises energy consumption in navigation.

A change of trim angle to approach the vertical of the AUV may be required to carry out certain operations, including in particular site monitoring using cameras equipped in the AUV, or realignment of the navigation system thanks to AUV antennas placed out of the water, or simply to recover the AUV.

Different devices for modifying the trim angle of an AUV are known.

One of these devices is formed from a thrust system, comprising one or more thrusters, mounted on the AUV and which is actuated to change the trim angle of the AUV.

This is in particular possible when the thrust system has one of the following configurations:

- One or more vertical thrusters (for example one at the front and one at the rear of the vehicle). Thus, the opposite thrusts of the thrusters induce a modification of the trim angle of the vehicle;
- Horizontal thrusters located far from the main longitudinal axis of the vehicle. Thus, the thrusts of opposite thrusters induce a torque on the vehicle, which modifies the trim angle of the vehicle;
- One or more orientable thrusters, such that by modifying the orientation of the thrusters and therefore of the thrust, the trim angle of the vehicle can be modified.

Another of these devices is formed from so-called trimming tanks housed at the front and at the rear of the AUV. Each trimming tank defines a volume and is at least partially filled with fluids. The quantities of fluids vary in the different tanks to vary the trim angle of the AUV.

The thrusters and the trimming tanks can also be simultaneously integrated in an AUV to increase the trimming capacities.

SUMMARY

The aim of the disclosure is that of providing an autonomous underwater vehicle including an uprighting device which is particularly simple and convenient, both in the manufacture and use thereof.

The disclosure thus relates, according to a first aspect, to an autonomous underwater vehicle comprising a hull extending along a longitudinal main axis, at least one vehicle uprighting device configured to modify a trim angle of the vehicle between a horizontal nominal position of the vehicle and a vertical position of the vehicle, characterised in that the vehicle uprighting device comprises one or more arms mounted on the hull by a proximal end and rotatably hinged in relation to the hull, and comprising a float at a distal free end such that the arm is configured to adopt:

- a retracted position when the vehicle is in the nominal position with a substantially zero trim angle, wherein the arm is substantially parallel with the longitudinal main axis of the vehicle and the float is in the immediate vicinity of the hull;
- a deployed position wherein the arm is inclined relative to the longitudinal main axis so as to bring and/or stabilise the vehicle in the so-called vertical position with a trim angle greater than 70 relative to its nominal position.

In the autonomous underwater vehicle according to the disclosure, the hinged arm makes it possible to move the float away from the hull of the vehicle and, on account of the floatability of the float, this makes it possible to modify the position of the centre of volume of the vehicle, also known as centre of buoyancy or thrust, with the aim of facilitating the uprighting of the vehicle. The deployment of the arm only requires very low energy, which is advantageous for autonomous vehicles. In addition to being convenient, adding such an arm equipped with a float is a compact solution since only changes the architecture of the autonomous underwater vehicle very slightly.

According to an aspect, the autonomous underwater vehicle can comprise at least two arms, fastened to the hull at port and at starboard, arranged so as to form an angle between them within the range [60°; 180°].

An autonomous underwater vehicle can comprise at least one actuation member enabling the arm to switch from the retracted position to the deployed position.

The actuation member can furthermore enable the arm to switch from the deployed position to the retracted position.

Alternatively, only an irreversible deployment of the arm is possible.

According to an aspect, the actuation member is capable of orienting the arm in a determined or selected angular position relative to the longitudinal main axis.

According to an aspect, the actuation member can be configured to adapt, according to the trim angle of the vehicle, the angular position of the arm in the deployed position, relative to the longitudinal main axis.

According to an aspect, the autonomous underwater vehicle can comprise a verticality sensor, such as an accelerometer, such that the angular position of the arm is monitored and controlled according to the output signal of the verticality sensor. This makes it possible to ensure a stability of the AUV in its vertical or almost vertical position, even in the case of environment-related disturbances, and in particular swell effects or water density.

According to an aspect, the float can have a variable volume. This can impact on the position of the centre of thrust and therefore also make it possible to improve the stability of the AUV in its vertical or almost vertical position.

According to an aspect, at least one of the arms can be telescopic. This makes it possible to set a distance between the distal end and the proximal end of the arm, so as to move the floats closer to or away from the hull of the vehicle. It is possible to facilitate the uprighting of the vehicle. This distance can be monitored and controlled also thanks to a verticality sensor.

According to an aspect, the autonomous underwater vehicle can additionally comprise one or more trimming tanks capable of varying the trim angle of the vehicle.

According to an aspect, the autonomous underwater vehicle can additionally comprise one or more thrusters capable of varying the trim angle of the vehicle.

The combination of the arm and the trimming tanks and/or thrusters makes it possible to further facilitate the uprighting of the autonomous underwater vehicle. In particular, the trimming tanks and/or the thrusters make it possible to initiate the uprighting of the autonomous underwater vehicle, and when the trim angle reaches a threshold value, the arm can be deployed so as to finalise the uprighting and ensure the stability of the vehicle, once the vehicle has been uprighted.

According to an aspect, the trimming tanks can be disposed, when the vehicle is in the nominal position, in an upper part of the hull and the arms are attached to a lower part of the hull of the vehicle.

The disclosure relates, according to a second aspect, to a method for uprighting a vehicle as described above, comprising the actuation of the arm to place it in the deployed position, from the retracted position, in particular when the trim angle of the vehicle reaches a first threshold angle.

According to an aspect, the method can comprise beforehand the initiation of the uprighting of the vehicle via trimming tanks and/or thrusters.

According to an aspect, the method can comprise the actuation of the arm to place it in the retracted position from the deployed position when the trim angle of the vehicle is less than a second threshold angle.

Other specific features and advantages of the disclosure will also become apparent in the following description.

BRIEF DESCRIPTION OF THE FIGURES

The disclosure, according to several aspect examples, will be better understood and its advantages will appear better upon reading the following detailed description, given for an indicative and non-limiting purpose, with reference to the appended drawings wherein.

DETAILED DESCRIPTION

Identical elements represented in the abovementioned figures are identified by identical reference numbers.

The disclosure finds an application in the field of autonomous underwater vehicles, intended to be used once or several times, following their recovery in the open sea.

The disclosure applies in particular to vehicles known as AUVs, as described above.

In general, the autonomous underwater vehicles are used to perform different operations at sea, such as for example monitoring operations.

For this, the autonomous underwater vehicles are launched from a boat (such as for example unmanned surface vessel (USV) type boats) or from a submarine, or from an aircraft, and navigate completely submerged in water in a nominal position close to horizontal.

Figure 1:
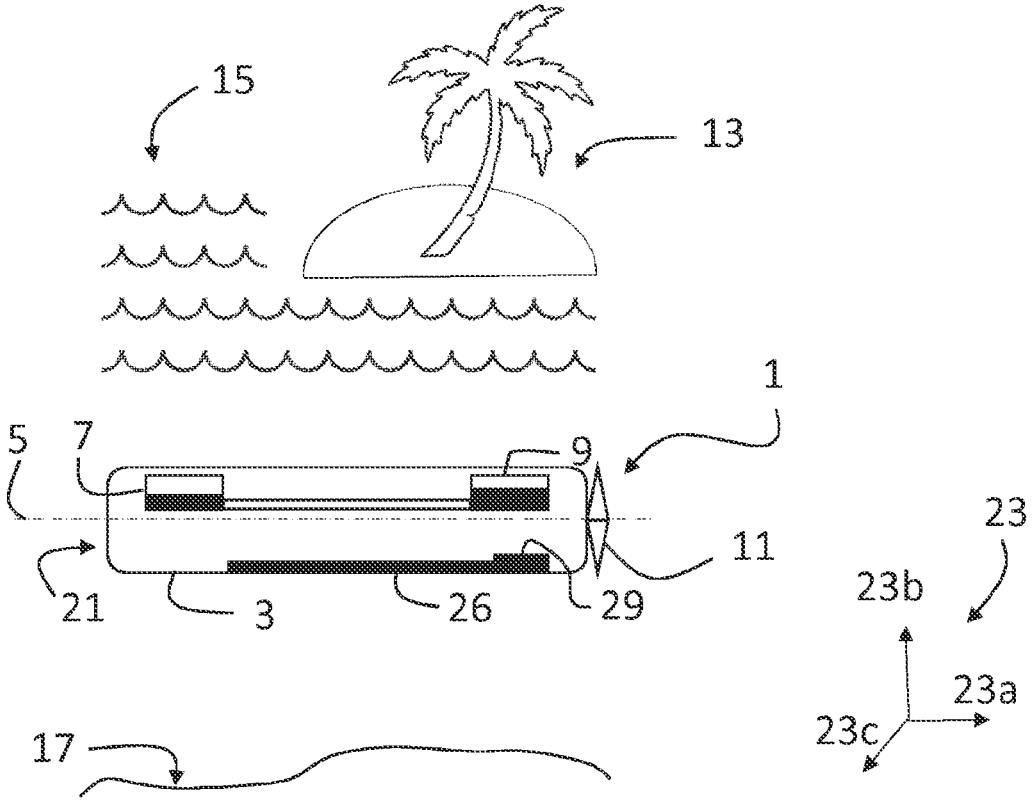
FIG. 1 illustrates an autonomous underwater vehicle according to the disclosure.

An example of autonomous underwater vehicle 1 navigating at sea 15 is thus illustrated in FIG. 1. Hereinafter in the description, the terms vehicle and autonomous underwater vehicle are used indiscriminately to denote an autonomous underwater vehicle. The autonomous underwater vehicle 1 comprises a hull 3, of optionally cylindrical shape. In certain aspects, the underwater vehicle can be of any other shape. This hull extends along a longitudinal main axis 5. In the example illustrated, the longitudinal main axis 5 passes through the nose 21 of the autonomous underwater vehicle 1 and a thrust system 11, such as helical thrusters for example.

The vehicle 1 is illustrated in FIG. 1 in the nominal navigation position, wherein the longitudinal main axis 5 is substantially parallel with the horizontal axis. Hereinafter in the description, horizontal plane denotes a plane having an orientation parallel with the horizon.

In the nominal navigation position, the hull 3 comprises an upper part 3*a* facing the surface of the sea 15, and a lower part 3*b* facing the seabed 17.

In order to minimise the effect of drag forces, as a general rule, during nominal navigation of the vehicle (apart from operations requiring change of orientation type manoeuvres), the vehicle is configured to navigate in the nominal position illustrated in FIG. 1, i.e. wherein the main longitudinal axis 5 forms a zero or virtually zero angle with the horizontal plane. For example, the angle formed is an angle between 0° and 10°. This angle, hereinafter referred to as trim angle, is the longitudinal inclination of the vehicle 1, i.e. the trim angle formed by the longitudinal main axis 5 with the horizontal plane 19 (parallel with the direction 23*a* of the frame of reference 23).

To allow an autonomous underwater vehicle to be handled under water, the underwater vehicle must neither rise nor descend in its nominal position, which means that the vehicle must have a zero or virtually zero angle in the equilibrium position.

The nominal position of the vehicle 1 is an equilibrium position of the vehicle 1 when it is submerged, and is dependent in particular on the relative position of the centre of gravity and the centre of thrust, also known as the centre of buoyancy or volume. When the forward speed is zero, the nominal position of the vehicle, for a vehicle of zero floatability, is characterised in that the centre of gravity and the centre of thrust are aligned along the vertical (direction 23*b* orthogonal to the horizontal plane 19).

The centre of gravity of the vehicle 1 is dependent on its architecture, i.e. the mass distribution of its body and the elements it includes inside the hull. The centre of thrust of the vehicle, the location of the vehicle where the hydrostatic forces, "Archimedes thrust", are applied, varies according to the distribution of the volumes in the vehicle.

The equilibrium position can vary when the vehicle 1 is handled, in particular when the speed of the vehicle 1 is modified, due to the influence of the hydrodynamic forces.

Figure 2:
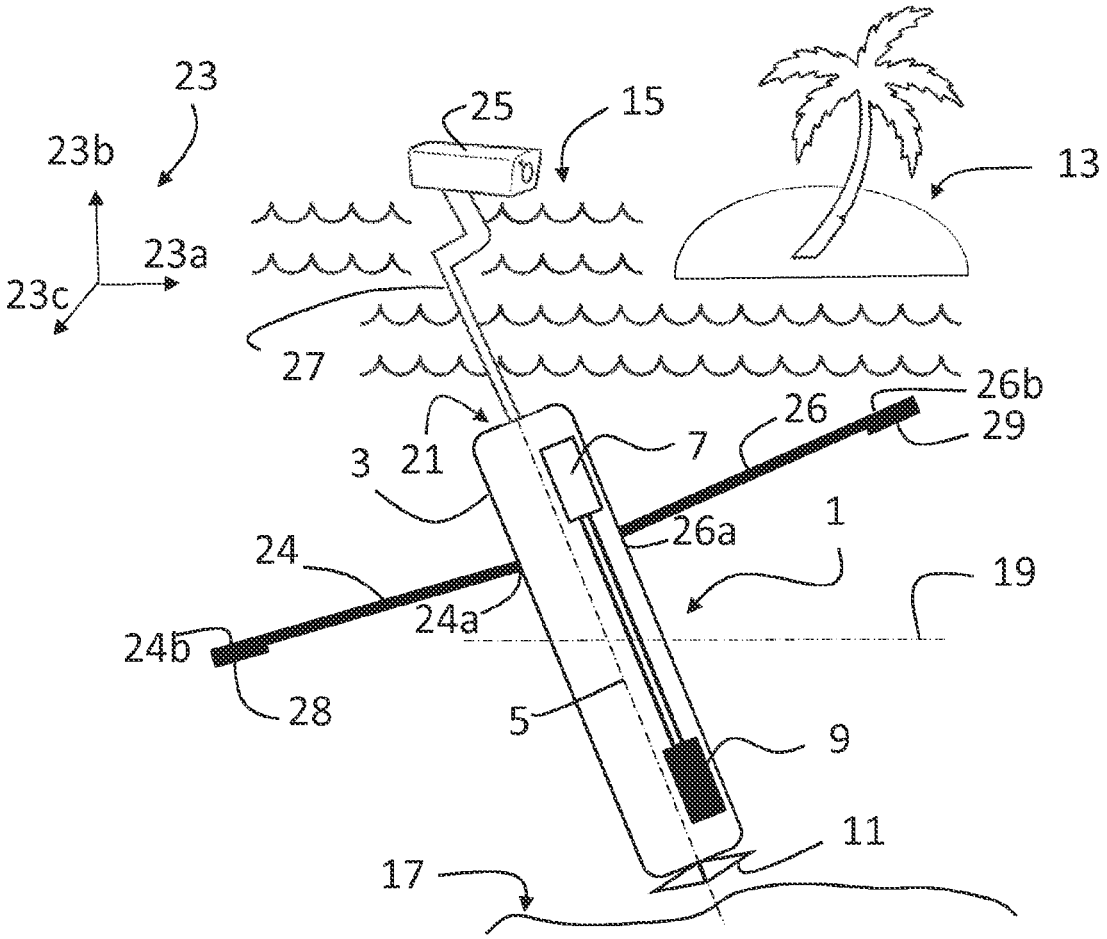
FIG. 2 illustrates an autonomous underwater vehicle according to the disclosure for which uprighting has been initiated.

Also, it appears necessary to modify this equilibrium position of the vehicle to carry out operations requiring change of orientation type manoeuvres, such as uprighting, as illustrated in FIG. 2, described hereinafter.

The vehicle 1 therefore comprises elements making it possible in particular to manage the relative position of the centre of gravity and centre of thrust in order to modify the equilibrium position of the vehicle 1 for carrying out the different manoeuvres. In other words, this consists of modifying the trim angle of the vehicle 1.

As stated above, the underwater vehicle 1 comprises here a thruster 11 disposed at one end of the hull 3 of the vehicle and which is capable of modifying the movement speed of the vehicle under the water and also of handling the vehicle. Handling the underwater vehicle means enabling its movement along the three directions 23*a*, 23*b*, 23*c* identified by the frame of reference 23 represented in FIG. 1.

The thrust applied to the vehicle 1 by the thruster 11 then drives the vehicle 1 with the part 21, called the nose, in front of the rest of the vehicle 1. In the example illustrated, the nose 21 and the thruster 11 are aligned along the longitudinal main axis 5 of the vehicle 1.

In addition to the thruster 11, the vehicle 1 comprises trimming tanks 7, 9 respectively disposed to the front and the rear of the vehicle 1. This consists of tanks 7, 9 defining a volume, partially filled with a liquid, such as water or oil. The volume of liquid contained in the trimming tanks 7, 9 can be modified, so as to vary the centre of thrust of the vehicle 1, thus making it possible to vary the trim angle of the vehicle 1. In the example illustrated, the trimming tanks 7, 9 are connected to one another by a pipe, thus forming a closed circuit.

Alternatively, the trimming tanks can intake liquid (for example seawater) from the outside or discharge liquid to the outside. The intake of seawater, to weigh down the trimming tanks, can be performed via a valve coupled with a flow limiter (in particular in the case of overpressure outside the vehicle). The water can be discharged from the trimming tanks via a pump advantageously coupled with a non-return valve. This variation of the overall volume of liquid in the trimming tanks makes it possible to vary the weight of the vehicle in water. This makes it possible to move the vehicle closer to and away from the surface.

The variation of the volume contained in the trimming tanks 7, 9 makes it possible to modify the position of the centre of thrust by modifying the distribution of the weight inside the hull 3 of the vehicle.

These tanks are disposed, in general, to the front and the rear of the vehicle 1. Obviously, the vehicle 1 can comprise several other trimming tanks 7, 9, disposed differently (at starboard and at port for example).

Thus, as mentioned above, the thrusters and the trimming tanks can be used (regardless of their positions) to initiate the uprighting of the vehicle 1, as illustrated in FIG. 2.

FIG. 2 illustrates an example of monitoring operation of a zone of interest 13, requiring "permanent" uprighting of the vehicle 1.

The so-called "permanent" uprighting, i.e. for a desired determined duration, of a vehicle 1 proves to be an operational asset during the use of the vehicle 1 and in particular during the use of the onboard sensors of the vehicle 1.

Indeed, the use of the sensors is less impacted by swell when the AUV is in the vertical position rather than in the horizontal position, then ensuring that good quality data are obtained, the whole in great discretion.

Also, during phases of use of the satellite geolocation and navigation system, such a permanent vertical position of the AUV can prove to be interesting, in particular to place the antennas of the AUV out of the water, for example during the realignment phases of the navigation system, or communication phases (radio or satellite).

Furthermore, the permanent uprighting can also prove to be advantageous, in particular during the phases of sea recovery of the AUV, in particular to recover the AUV by the nose in order to remove it from the water.

The initiation of the uprighting of the vehicle 1 is aimed at switching the vehicle 1 from the nominal position (illustrated in FIG. 1) to a position close to the vertical (illustrated in FIG. 2): this is performed by varying the trimming angle of the vehicle, such that the vehicle in equilibrium in the water, switches from a substantially zero trim angle to a trim angle greater than 60°.

In the example illustrated, the monitoring operation is aimed at monitoring via a camera 25 the zone of interest 13. The camera 25 is disposed on an arm attached to the hull 3 of the vehicle 1. This, the onboard camera 25 is extended above the surface of the water 15 towards the zone of interest 13 (via an arm 27), and then makes it possible to obtain images of the zone of interest 13 the sharpness of which is satisfactory for monitoring activities.

The uprighting can be initiated with the trimming tanks alone, in particular by weighing down the rear of the vehicle relative to the front of the vehicle. For this, for example, the rear trimming tank 9 is entirely filled with liquid, whereas the front trimming tank 7 is entirely filled with air. Thus, the position of the centre of thrust is modified, such that the position of the centre of thrust is shifted towards the nose 21 of the vehicle bringing about a modification of the trim angle of the vehicle.

In some cases, the uprighting can be initiated via the thrust system, having one of the configurations as described above.

As seen in FIG. 2, the initiation of the uprighting makes it possible to obtain a trim angle of the vehicle 1 which is of the order of 70°, such that the main longitudinal axis of the vehicle is not parallel with the vertical direction 23*b*.

The vehicle 1 furthermore includes one or more arms 24, 26 which are part of the uprighting device and which are mounted by a proximal end 24*a*, 26*a* on the hull 3 and rotatably hinged relative to the hull 3, and comprising a float 28, 29 at a distal free end 24*b*, 26*b*. As explained hereinafter in detail, the arm(s) are configured to adopt:

- a retracted position when the vehicle is in the nominal position with a substantially zero trim angle, wherein the arm is substantially parallel with the longitudinal main axis of the vehicle and the float is in the immediate vicinity of the hull;
- a deployed position wherein the arm is inclined relative to the longitudinal main axis so as to bring and/or stabilise the vehicle in the so-called vertical position with a trim angle greater than 70° relative to its nominal position (and ideally 90°).

As illustrated in FIGS. 3A, 3B, 4A and 4B, the autonomous underwater vehicle 30 comprises an uprighting device comprising a single arm 32. The arm 32 comprises two ends, one distal end and one proximal end. The proximal end is the end of the arm 32 which is rotatably mounted on the hull 40 of the vehicle 30 and the distal end comprises a float 34, i.e. an element wherein the volume density is less than that of water. The float 34 is rigidly connected to the arm 32.

Figure 3A:
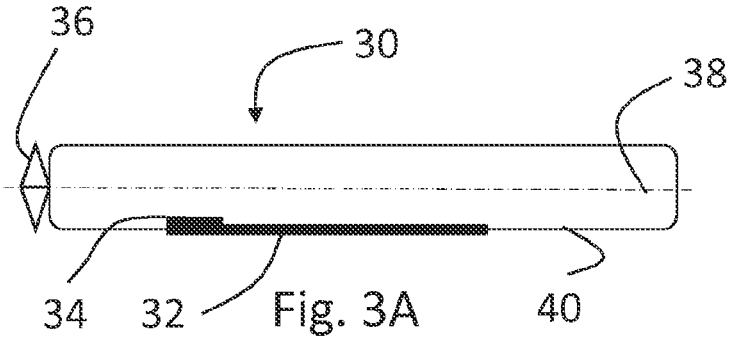
FIGS. 3A and 3B illustrate a first aspect of the disclosure, showing an AUV having an arm in the retracted position.
Figure 3B:
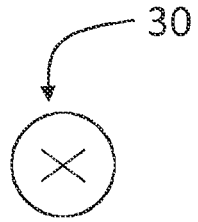

As seen in FIGS. 3A and 3B, the arm is capable of being disposed in a retracted position wherein the float 34 is here retracted inside the hull 40 of the vehicle 30. In this retracted position, the arm is disposed substantially parallel with the longitudinal main axis 38 of the vehicle 30, so as not to project from the hull 40 of the vehicle 38, and therefore not impact the movement of the vehicle 30 (by creating drag forces).

Figure 4A:
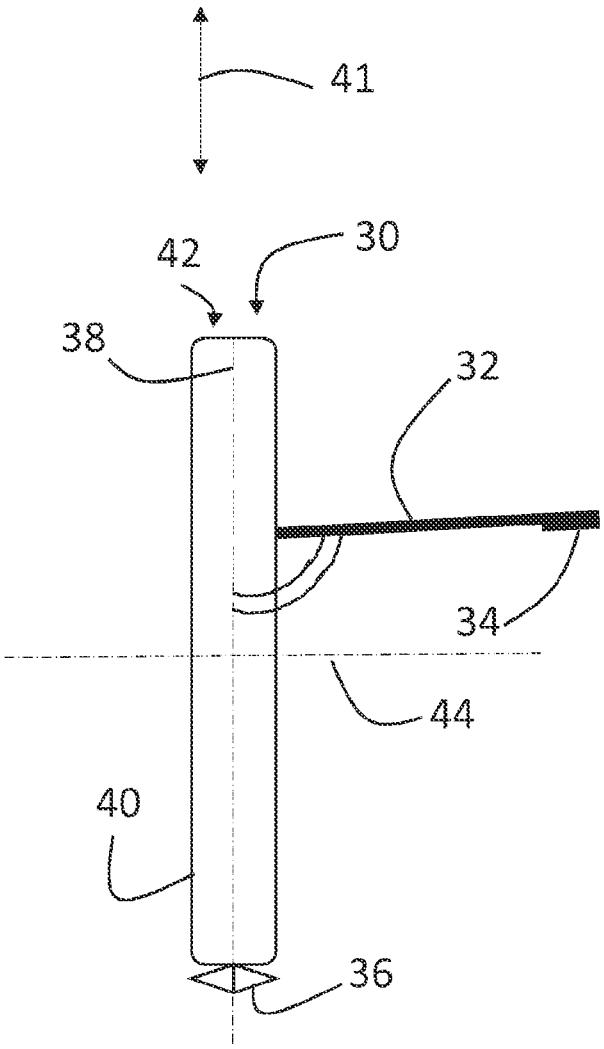
FIGS. 4A and 4B illustrate the first aspect of the disclosure, wherein the arm is in the deployed position.
Figure 4B:
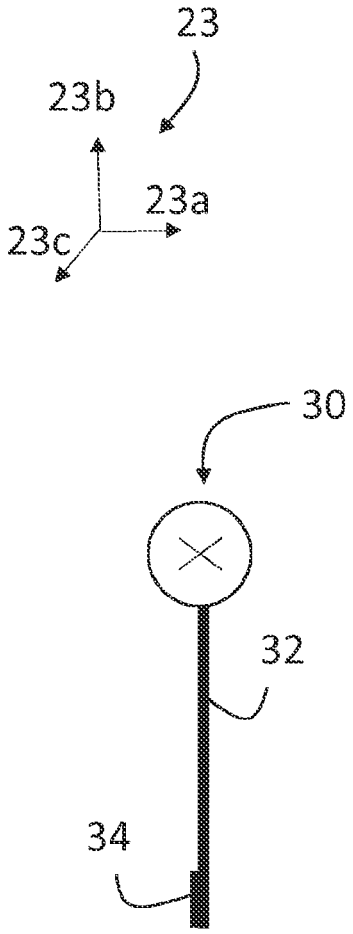
Figure 5A:
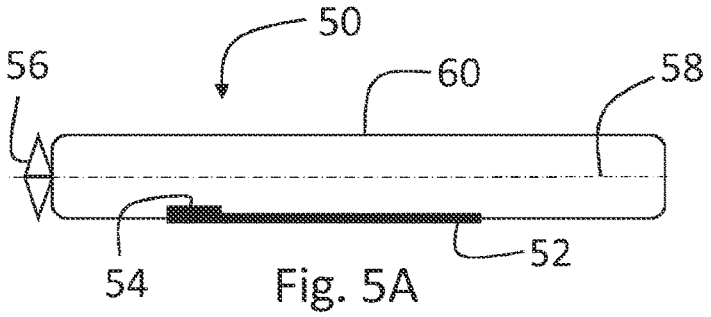
FIGS. 5A and 5B illustrate a second aspect of the disclosure, showing an AUV having two arms in the retracted position.
Figure 5B:
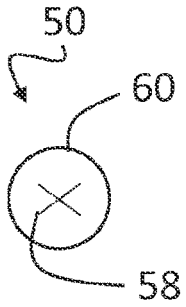
Figure 6A:
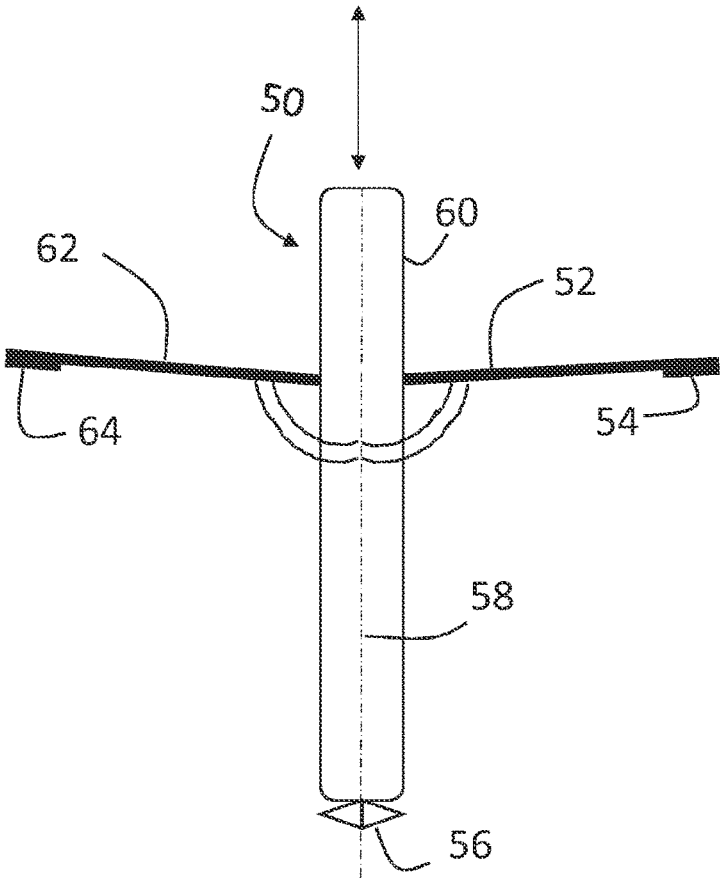
FIGS. 6A and 6B illustrate the second aspect of the disclosure, wherein the arms of the vehicle are in the deployed position.
Figure 6B:
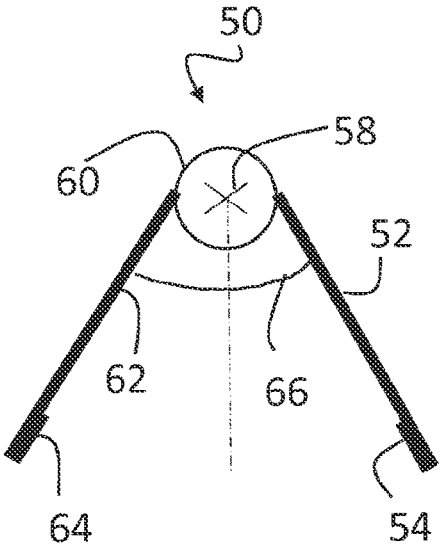

The arm 32 is rotatably mounted on the hull 40 so as to be at least rotatable and form an angle relative to the longitudinal main axis 38 in the deployed position, as illustrated in FIGS. 4A and 4B.

The axis of rotation is an axis orthogonal to the longitudinal main axis 5, and oriented along the direction 23*c* of the frame of reference 23 reproduced in FIGS. 4A and 4B. The rotation of the arm 32 from the retracted position to the deployed position makes it possible to place the float 34 at a distance from the hull 40 of the vehicle 30.

By thus disposing the float 34 at a distance of the hull 40 of the vehicle, floatability of the float acts upon the position of the centre of thrust of the vehicle.

Indeed, when the arm 32 is in the deployed position, the float 34 is placed at a distance from the hull 40 of the vehicle 30, such that this influences the position of the centre of the thrust of the vehicle 30. In particular, the float 34 makes it possible to move a volume of water at a distance from the hull 40 of the vehicle 30, such that the position of the hydrostatic forces applied to the vehicle 30 is modified giving rise to the modification of the position of the centre of thrust. The deployment of the arms then makes it possible to act mainly on the position of the centre of thrust, by moving it towards the nose 42 of the vehicle 1.

Thus, during the deployment of the arm 32, the vehicle can continue its movement towards the vertical and the stability of the vehicle in the vertical position can be enhanced. The features of the arms and the floats are chosen so as to make it possible, during the deployment of the arm, to move the centre of thrust towards the nose 42.

The arm 32 is disposed advantageously, at the bottom hull of the vehicle 30.

The arm of this example is described as passive arm, as its positioning relative to the longitudinal main axis 38 is dependent on the features of the float (for example its floatability) but also on the length of the arm.

According to certain aspects, the arm 32 and the float 34 are configured so that, in the deployed position, the arm 32 is substantially perpendicular to the longitudinal main axis 38 of the autonomous underwater vehicle 30. In certain aspects, the arm 32, in the deployed position, forms an angle with the longitudinal main axis 38 of the vehicle 1 included in the range [80; 100].

The deployment of the arm can be triggered via an actuator or by initiating the uprighting movement, as illustrate in FIGS. 4A and 3A (arrow 41).

In an aspect, the deployment of the arm can be performed via an actuation member then enabling the arm to switch from a retracted position to a deployed position only. Thus, the arm, once deployed, cannot be retracted into the retracted position, wherein the float is retracted into the hull. Such a solution is particularly suitable in the context of so-called consumable autonomous underwater vehicles, usable a single time at sea.

In particular, the actuation member comprises a spring arranged between the arm 32 and the hull 40 of the vehicle 30 and a switch (cutout type for example, on/off) configured to activate the spring, so that the latter exerts a force on the arm 32 to switch it from a retracted position, substantially perpendicular to the main axis 38, to a deployed position. Activate means that the switch is configured to enable the spring to apply a force on the arm 32, such that it adopts a deployed position.

Even though a single arm is illustrated, it is possible to have two or more arms, fastened to the hull, preferably to the bottom hull, at port and at starboard. The arms are then preferably arranged so as to form an angle within the range [60°; 180°].

The operation of these so-called passive arms 32 requires an initiation of uprighting (as described above), via the trimming tanks (not shown) and/or by the thrust system 36 of the vehicle.

For uprighting with this passive arm 32, the trimming tanks and/or the thrust system 36 are controlled to initiate uprighting, and the passive arm 32 is then deployed to obtain a synergistic action with the trimming tanks and/or the thrust 36. When the deployment of the arm 32 is performed via an actuation member, the arm 32 is then deployed "at the right time" when the initiation of the uprighting enables the vehicle to have a trim of the order of 70°, making it possible to improve the verticality and the stability of the AUV in the vertical position.

In the case where the vehicle comprises more than one arm 32, the deployment of the arms can be performed simultaneously or one after the other according to a sequence, such as for example starboard then port.

With reference now to FIGS. 5A, 5B, 6A and 6B, the vehicle 50 comprises two arms 52, 62 respectively comprising two floats 54, 64 at their distal end. The arms are attached preferably to the bottom hull, respectively at port and at starboard. Advantageously, the arms are disposed so as to form an angle 66 within the range [60°; 180°].

The arms 52, 62 can be actuated via an actuation member enabling one of the arms to switch from a retracted position to a deployed position and conversely.

In an aspect, the actuation member for deploying the arms 52, 62 and conversely, comprises in particular a motor, capable of orienting the arms 52, 62 in several angular positions relative to the longitudinal main axis. Thus, the motorised arms 52, 62 are orientable at least about their axes of rotation (as stated above, orthogonal to the longitudinal main axis 58 of the vehicle 50) so as to enable the deployment of the arms 52, 62 in selected deployed positions, for example according to the angle between the longitudinal main axis 58 of the vehicle 50 and the arm 52, 62.

In an aspect, the actuation member, i.e. the motor, is configured to adapt an angular position of the arm in the deployed position, relative to the longitudinal main axis according to the trim angle of the vehicle. For example, the vehicle 50 can comprise a verticality sensor, such as one or more accelerometers, such that the angular position of the arm is monitored and controlled according to the output signal of the verticality sensor.

Thus, the value of the angle between the arm and the hull of the vehicle can be regulated. This makes it possible in particular to ensure good verticality of the AUV, even in the case of disturbances of the environment, such as for example in the case of swell, or linked with water density.

The active control of the position of the arm relative to the hull 60 of the vehicle 50 makes it possible to dynamically stabilise the vehicle 50. The two motorised arms 52, 62 make it possible to handle the vehicle regardless of its speed, even at zero speed.

In an aspect, the float is configured to have a variable volume. Thus, according for example to the environmental conditions (such as a sudden appearance of an unusual swell), it is possible to increase the floatability capacity of the float and therefore stabilise the vehicle.

In an aspect, the arm is telescopic, to the extent that the length of the arms can be adjustable. Thus, the effect of the arms on the centre of thrust can be modified by varying the length of the arms.

Obviously in an advantageous aspect, it is possible to vary the volume of the float and the length of the arm.

Even though in the example illustrated, the vehicle 50 comprises two active arms 52, 62, it can in an aspect comprise a single active arm, or one or two active arms.

In an aspect, the uprighting device furthermore comprises active arms of other elements, such as the trimming tanks and/or the thrust system 56. In this case, the arms 52, 62 are deployed after uprighting has been initiated by the trimming tanks and/or the thrust system 56.

In an aspect, the uprighting device is then configured to control the arms 52, 62 and/or the trimming tanks and/or the thrust system 56. In an advantageous aspect, the uprighting device comprises a control unit capable of controlling the different elements, in order to ensure the synchronisation of their impacts on the centre of thrust of the vehicle 80.

Figure 8:
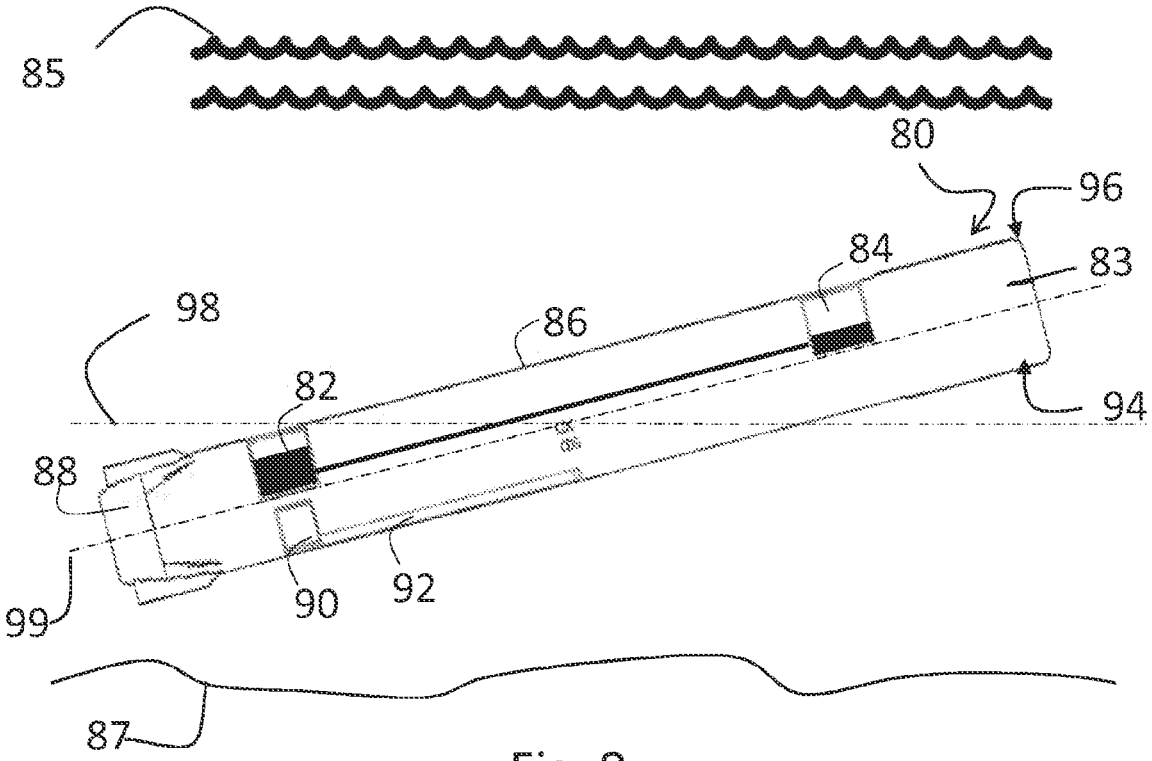
Figure 9:
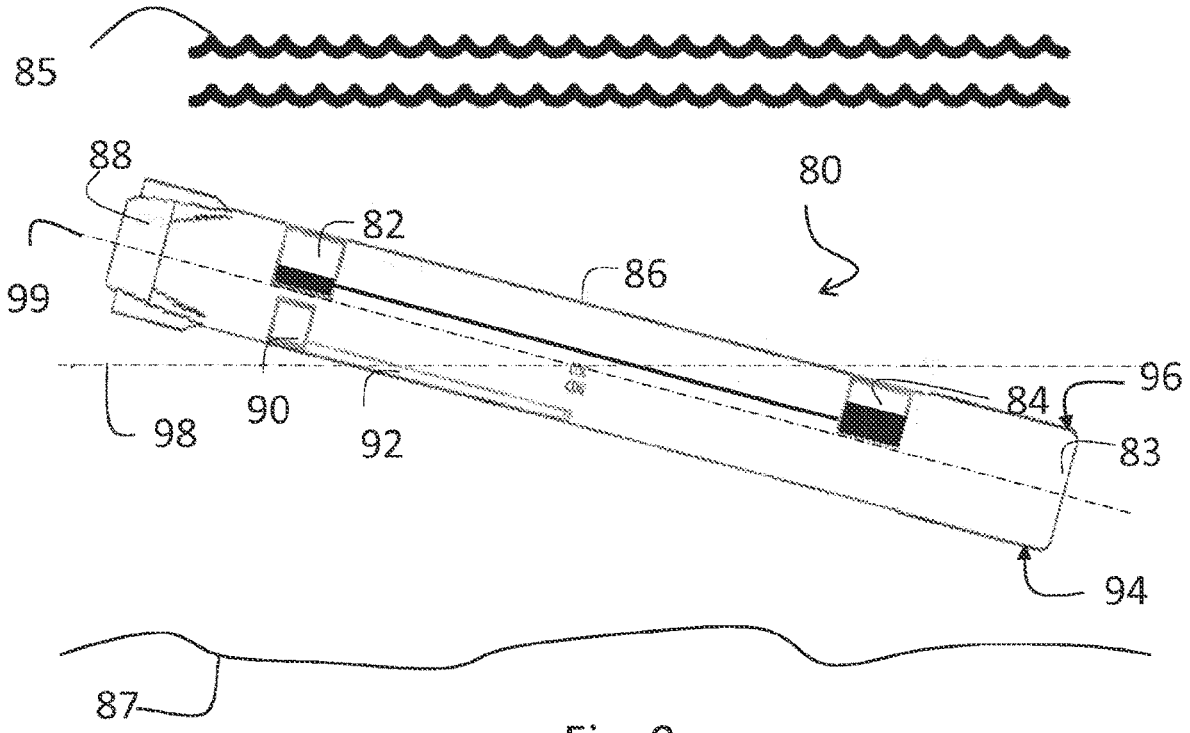
Figure 10:
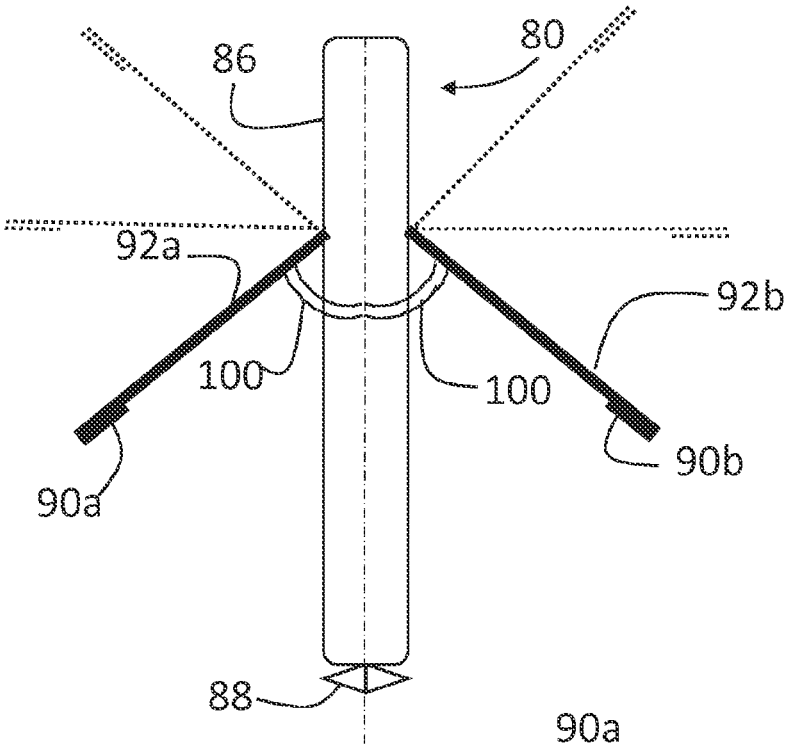
FIG. 10 illustrates examples of different positions of the arms of the third aspect.

The use of the motorised arms in addition to trimming tanks is illustrated in FIGS. 8 to 10.

The vehicle 80 illustrated in these figures is generally cylindrical, measures approximately 6.5 m long and has a diameter of approximately 0.5 m. This vehicle 80 has a mass of approximately 1200 kg and when it is submerged, this vehicle 80 moves approximately 1100 litres of water.

The trimming tanks 82, 84 of the vehicle 80, have respectively a maximum volume of 55 litres. These trimming tanks 82, 84 are respectively disposed 2 m behind and in front of the centre of gravity (CDG) and the centre of thrust (CDC in the figures) which are aligned along the vertical. The rear trimming tank 82 is thus disposed between the centre of gravity (or thrust) and the thrust system 88, and the front trimming tank 84 is disposed between the centre of gravity (or thrust) and the nose 83 of the vehicle 80.

Figure 7:
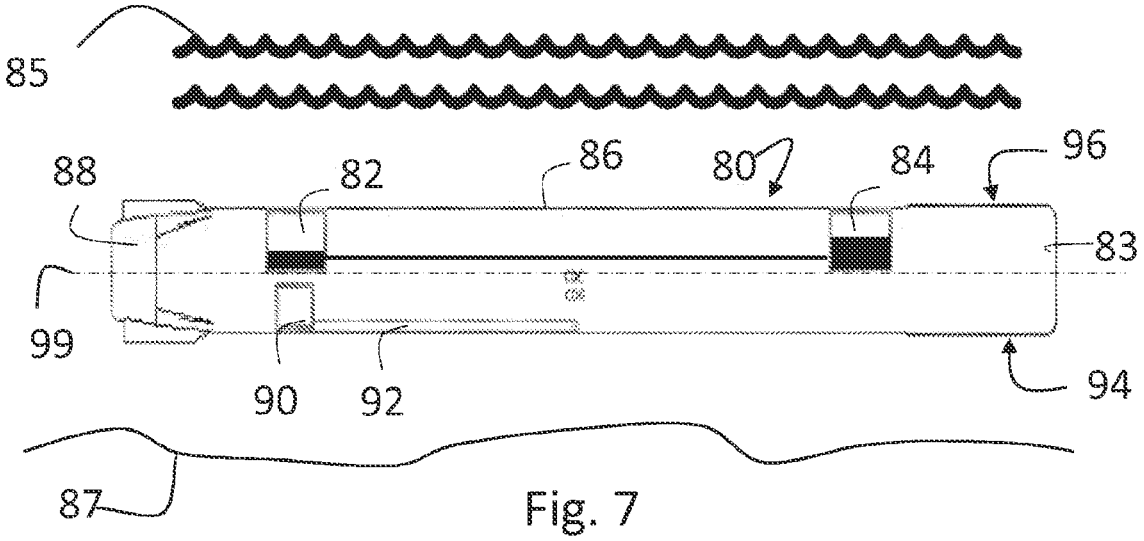
FIGS. 7, 8 and 9 illustrate a third aspect showing an AUV having trimming tanks in addition to arms.

As can be seen in FIGS. 7 to 9, the autonomous underwater vehicle 80 comprises trimming tanks 82, 84 which are disposed, when the vehicle 80 is in the nominal position, in an upper part 96 of the hull 86 and the arms are attached to a lower part 94 of the hull 86 of the vehicle 80.

As can be seen in the figures, as a general rule, the trimming tanks 82, 84 and the arms 90 are disposed on either side of the longitudinal main axis 99.

In the aspect illustrated, the trimming tanks are disposed inside the hull of the vehicle 80, in particular in a so-called upper part 96, which, when the vehicle 80 navigates in the nominal position, is directed towards the surface 85. The arms are attached to the lower part 94 of the hull 86, which when the vehicle 80 navigates in the nominal position, is directed towards the seabed 87.

The trimming tanks make it possible to vary the trim angle of the vehicle 80. In this aspect, only the trimming tanks make it possible to vary the trim angle of the vehicle. FIGS. 7, 8 and 9 illustrate three configurations of the trimming tanks 82, 84, wherein the vehicle 80 has respectively a zero trim angle, a positive trim angle and a negative trim angle, when submerged in seawater (with a density estimated at 1030 kg/m$^3$).

In the first case where the trim angle is zero, i.e. when the vehicle 80 is in the nominal position, the trimming tanks are filled with 60% air at the front and 20% air at the rear.

In the second case, where the trim angle is substantially positive, the longitudinal inclination of the vehicle 80 relative to the horizontal plane 98 drives the nose 83 of the vehicle in the direction of the water surface 85. In this case, the filling of the trimming tanks is modified such that the rear trimming tank 82 has a greater filling rate than the front trimming tank 84.

In the third case, where the trim angle is substantially negative, the longitudinal inclination of the vehicle 80 relative to the horizontal plane 98 drives the nose 83 of the vehicle in the direction of the seabed 87. In this case, the filling of the trimming tanks is modified such that the front trimming tank 84 has a greater filling rate than the rear trimming tank 82.

Two arms 92 are rotatably mounted onto the hull 86 of the vehicle 80. At the free end of the arm 92, a float 90 is mounted.

In this example, the float has a volume of approximately 10 litres (i.e. 20 litres for both arms). Furthermore, the arms 92 configured to be deployed have a length of approximately 2 m.

The axis of rotation of the arms is here orthogonal to the longitudinal main axis 99.

For the uprighting, the trimming tanks 82, 84 are used in conjunction with the arms 92.

For an uprighting of the vehicle 80 as described above, and to ensure zero floatability of the vehicle 80 in the vertical position in seawater, the trimming tanks are filled with 80% air at the front and 0% at the rear 82. In other words, the rear trimming tank 82 must be entirely filled with liquid.

Thus trimmed, the trimming tanks make it possible to generate a vehicle trim angle of maximum 75°. The action of the arms, by their deployment, enables a regulation of the verticality of the vehicle 80, within a range of +/−12° trim angle about the vertical (i.e. about a trim angle of) 90°.

As seen in FIG. 10, the arms 92*a*, 92*b* can be positioned in several isolated positions (some of which are shown as dotted lines in FIG. 10). Thus, according to the environmental conditions wherein the vehicle is moving and according to the features of the vehicle 80, the position of the arms is controlled to adopt one or more isolated positions, when the vehicle initiates an uprighting or when the vehicle is in the vertical position, so as to form an angle greater than 0° and less than 180° with the longitudinal main axis of the vehicle 80.

The deployment of one or more arms in one of the deployed positions as illustrated in FIG. 10 is performed according to a method comprising in particular a step wherein, when the trim angle of the vehicle reaches a first threshold angle, the arm(s) is/are actuated to place them in the deployed position, from the retracted position.

For example, the deployment of the arms of the vehicle 80 can be performed following a modification of the trim angle of the vehicle, for example using the trimming tanks 82, 84 and/or the thrust system, such that this trim angle becomes greater than this first threshold angle.

In an aspect, the uprighting of the vehicle 80 is initiated before the deployment of the arms, and performed for example via the trimming tanks 82, 84 and/or the thrust system.

For example, initiating the uprighting via the trimming tanks enables the vehicle 80 to reach a trim angle of approximately 75°.

In an aspect, the first threshold angle of 70° C. an be specified, such that the arms are deployed when the trim angle of the vehicle 80 exceeds 70° via the trimming tanks.

The method can also comprise a step of retracting the arm(s) of the vehicle 80, when the trim angle of the vehicle 80 becomes less than a second threshold angle.

Thus, when the vehicle is handled to return to a nominal position with a view to subsequent navigation, the arms are configured to be actuated and retracted, when the trim angle becomes less than the second threshold value.

What is claimed is:

1. An autonomous underwater vehicle comprising a hull extending along a longitudinal main axis, at least one device for uprighting the vehicle configured to modify a trim angle of the vehicle between a horizontal nominal position of the vehicle and a vertical position of the vehicle, characterised in that the device for uprighting the vehicle comprises one or more arms mounted by a proximal end onto the hull and rotatably hinged relative to the hull, and comprising a float at a distal free end such that the arm is configured to adopt:

a retracted position when the vehicle is in the nominal position with a substantially zero trim angle, wherein the arm is substantially parallel with the longitudinal main axis of the vehicle and the float is in the immediate vicinity of the hull;

a deployed position wherein the arm is inclined relative to the longitudinal main axis so as to bring and/or stabilise the vehicle in the so-called vertical position with a trim angle greater than 70 relative to its nominal position.

2. The autonomous underwater vehicle according to claim 1, comprising at least two arms, fastened to the hull at port and at starboard, arranged so as to form an angle between then within the range [60°, 180°].

3. The autonomous underwater vehicle according to claim 1, comprising at least one actuation member enabling the arm to switch from the retracted position to the deployed position.

4. The autonomous underwater vehicle according to claim 3, wherein the actuation member furthermore enables the arm to switch from the deployed position to the retracted position.

5. The autonomous underwater vehicle according to claim 4, wherein the actuation member is capable of orienting the arm in a determined or selected angular position relative to the longitudinal main axis.

6. The autonomous underwater vehicle according to claim 5, wherein the actuation member is configured to adapt, according to the trim angle of the vehicle, the angular position of the arm in the deployed position, relative to the longitudinal main axis.

7. The autonomous underwater vehicle according to claim 4, further comprising a verticality sensor, such as an accelerometer, such that the angular position of the arm is monitored and controlled according to the output signal of the verticality sensor.

8. The autonomous underwater vehicle according to claim 1, wherein the float has a variable volume.

9. The autonomous underwater vehicle according to claim 1, to wherein at least one of the arms is telescopic.

10. The autonomous underwater vehicle according to claim 1 comprising one or more trimming tanks and/or one or more thrusters, capable of varying the trim angle of the vehicle.

11. The autonomous underwater vehicle according to claim 10, wherein the trimming tanks can be disposed, when the vehicle is in the nominal position, in an upper part of the hull and the arms are attached to a lower part of the hull of the vehicle.

12. The uprighting method according to claim 10, comprising beforehand the initiation of the uprighting of the vehicle via the trimming tanks or thrusters of the vehicle.

13. A method for uprighting an autonomous underwater vehicle according to claim 1, comprising actuation of the arm to place it in the deployed position, from the retracted position, in particular when the trim angle of the vehicle reaches a first threshold angle.

14. The uprighting method according to claim 13 comprising actuation of the arm to place it in the retracted position from the deployed position when the trim angle of the vehicle is less than a second threshold angle.

* * * * *